US010386081B2

(12) United States Patent
Yokozeki et al.

(10) Patent No.: US 10,386,081 B2
(45) Date of Patent: Aug. 20, 2019

(54) AIR-CONDITIONING DEVICE

(71) Applicant: Johnson Controls-Hitachi Air Conditioning Technology (Hong Kong) Limited, Hong Kong (CN)

(72) Inventors: Atsuhiko Yokozeki, Tokyo (JP); Hiroaki Tsuboe, Tokyo (JP); Yoshiharu Tsukada, Tokyo (JP); Yuki Arai, Tokyo (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 0 days.

(21) Appl. No.: 15/532,115

(22) PCT Filed: Oct. 5, 2015

(86) PCT No.: PCT/JP2015/078157
§ 371 (c)(1),
(2) Date: Jun. 1, 2017

(87) PCT Pub. No.: WO2016/092943
PCT Pub. Date: Jun. 16, 2016

(65) Prior Publication Data

US 2017/0268790 A1 Sep. 21, 2017

(30) Foreign Application Priority Data

Dec. 12, 2014 (JP) ..... 2014-251677

(51) Int. Cl.
*F24F 1/18* (2011.01)
*F25B 41/06* (2006.01)
(Continued)

(52) U.S. Cl.
CPC ..... *F24F 1/18* (2013.01); *F24F 11/89* (2018.01); *F25B 1/00* (2013.01); *F25B 13/00* (2013.01);
(Continued)

(58) Field of Classification Search
CPC .. F25B 1/00; F25B 41/00; F25B 40/02; F25B 41/062; F25B 13/00; F25B 39/00;
(Continued)

(56) References Cited

U.S. PATENT DOCUMENTS 4,262,493 A * 4/1981 Lackey ..... F25B 13/00 62/324.6
4,407,137 A * 10/1983 Hayes, Jr. ..... F25B 13/00 62/151
(Continued)

FOREIGN PATENT DOCUMENTS

CN 101158502 A 4/2008
EP 1 031 801 A2 8/2000
(Continued)

OTHER PUBLICATIONS

International Search Report of PCT/JP2015/078157 dated Dec. 28, 2015.
(Continued)

*Primary Examiner* — Cassey D Bauer
(74) *Attorney, Agent, or Firm* — Mattingly & Malur, PC

(57) ABSTRACT

A heat exchanger includes a refrigerant flow path into which a gas refrigerant flows from two gas-side inlets in the second row, that are positioned off from each other. Refrigerant flow paths from the two gas-side inlets converge in the one end portion. The refrigerant flow path connects to a heat-transfer pipe in the first row from the second row. The refrigerant flow path includes a refrigerant flow path which is formed in a range from the same stage as one of the gas-side inlets of the second row to the same stage as the other of the gas-side inlets of the second row, while being arranged along both ways between the one end portion and the other end portion in the first row, and the refrigerant flow path extends to a liquid-side outlet.

9 Claims, 10 Drawing Sheets

(51) Int. Cl.

| | |
|---|---|
| ***F25B 13/00*** | (2006.01) |
| ***F25B 39/00*** | (2006.01) |
| ***F25B 40/02*** | (2006.01) |
| ***F24F 11/89*** | (2018.01) |
| ***F25B 1/00*** | (2006.01) |
| ***F25B 41/00*** | (2006.01) |
| ***F28D 1/047*** | (2006.01) |
| *F25B 39/02* | (2006.01) |

(52) U.S. Cl.
CPC ..... *F25B 39/00* (2013.01); *F25B 40/02* (2013.01); *F25B 41/00* (2013.01); *F25B 41/062* (2013.01); *F28D 1/047* (2013.01); *F25B 39/028* (2013.01)

(58) Field of Classification Search
CPC ..... F25B 39/028; F25B 47/006; F24F 1/18; F24F 11/89; F24F 1/50; F24F 13/30; F28F 9/0275; F28F 9/0204; F28F 9/0243; F28F 9/0273; F28F 9/028; F28F 9/26; F28D 1/0476
USPC ..... 62/183, 186, 324.1
See application file for complete search history.

(56) References Cited

U.S. PATENT DOCUMENTS

| | | | | |
|---|---|---|---|---|
| 5,076,353 | A | 12/1991 | Haussmann | |
| 5,542,271 | A * | 8/1996 | Kudoh | F25B 9/006 165/146 |
| 2004/0045304 | A1* | 3/2004 | Park | F24F 1/022 62/183 |
| 2005/0044882 | A1* | 3/2005 | Hong | F25B 39/04 62/507 |
| 2006/0048928 | A1* | 3/2006 | Maezawa | F25B 39/00 165/173 |
| 2006/0090487 | A1* | 5/2006 | Park | F25B 13/00 62/160 |
| 2009/0173072 | A1* | 7/2009 | Mastronarde | F28D 7/1623 60/659 |
| 2009/0277207 | A1* | 11/2009 | Park | F25B 13/00 62/324.6 |
| 2010/0300141 | A1* | 12/2010 | Fujimoto | F25B 1/10 62/498 |
| 2012/0118533 | A1* | 5/2012 | Jang | F25B 49/02 165/96 |
| 2013/0306285 | A1* | 11/2013 | Jindou | F25B 39/00 165/173 |

FOREIGN PATENT DOCUMENTS

| | | | |
|---|---|---|---|
| JP | 52-52148 | U | 4/1977 |
| JP | 4-17292 | U | 2/1992 |
| JP | 2000-304380 | A | 11/2000 |
| JP | 2003-064352 | A | 3/2003 |
| JP | 2008-241192 | A | 10/2008 |
| JP | 2011-145011 | A | 7/2011 |
| JP | 2013-113498 | A | 6/2013 |
| JP | 2014-020678 | A | 2/2014 |

OTHER PUBLICATIONS

Extended European Search Report received in corresponding European Application No. 15867854.0 dated Jul. 12, 2018.
Japanese Office Action received in corresponding Japanese Application No. 2018-107364 dated Mar. 26, 2019.

* cited by examiner

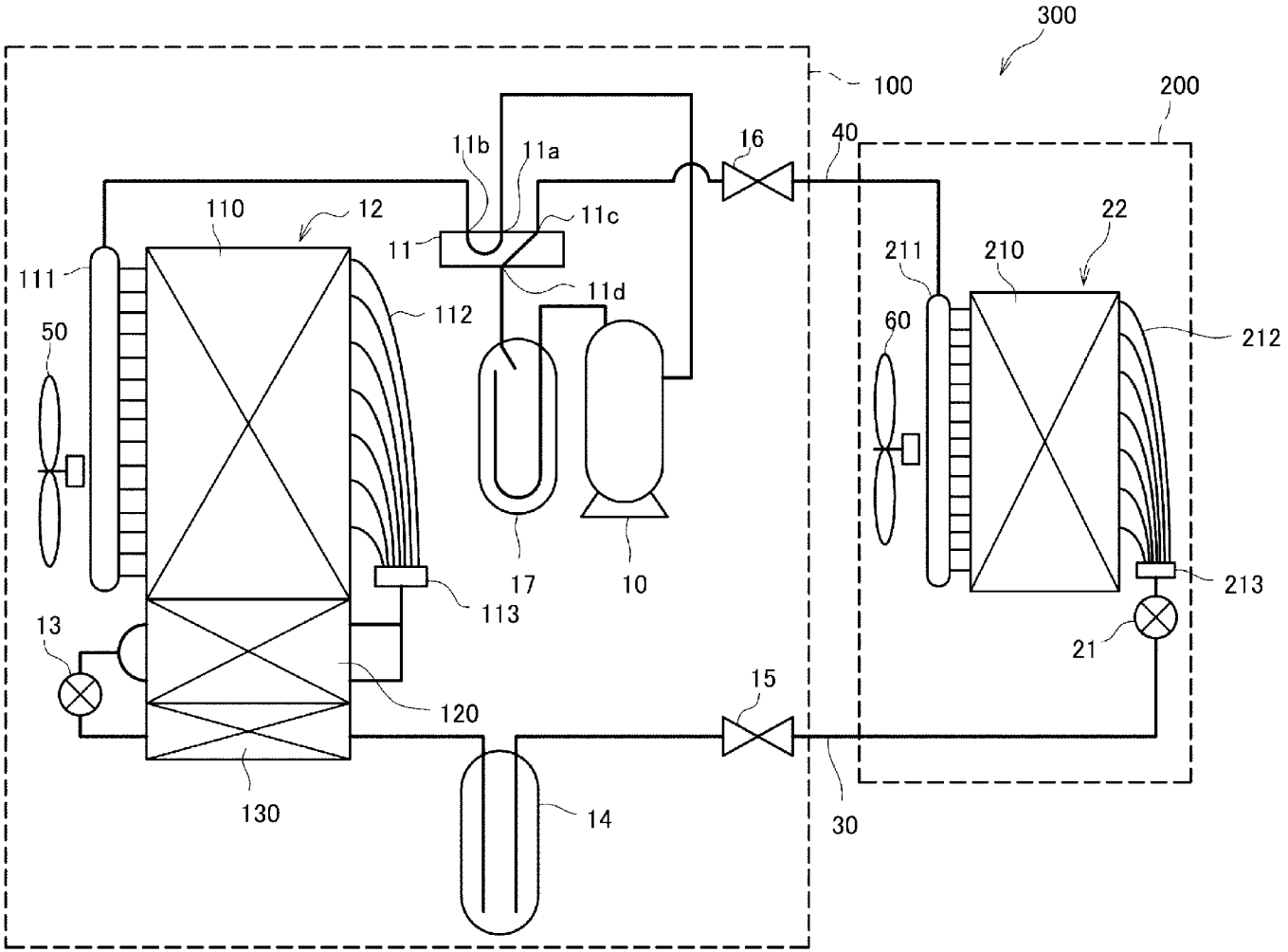
[Fig. 1]

[Fig. 2]
(a)
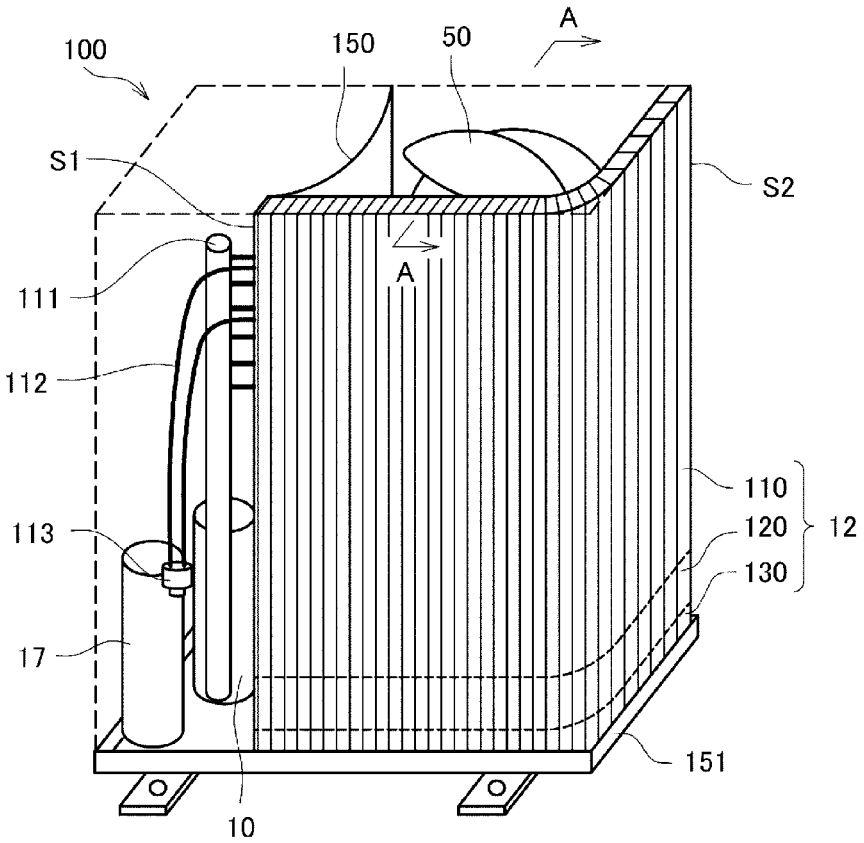
(b)
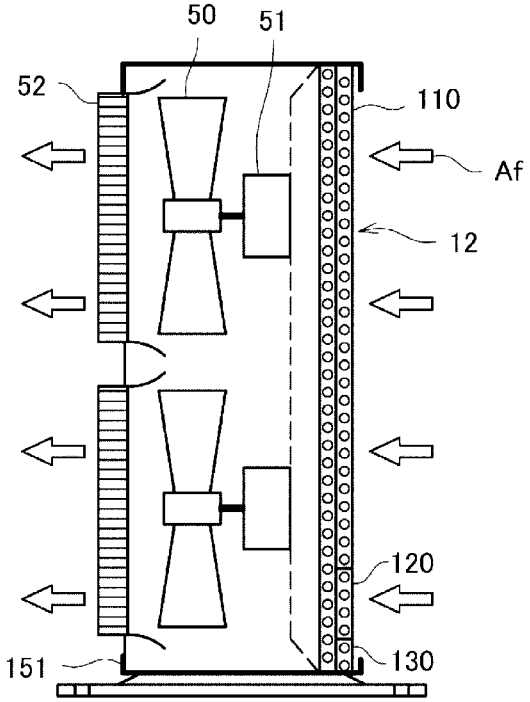

[Fig. 3]
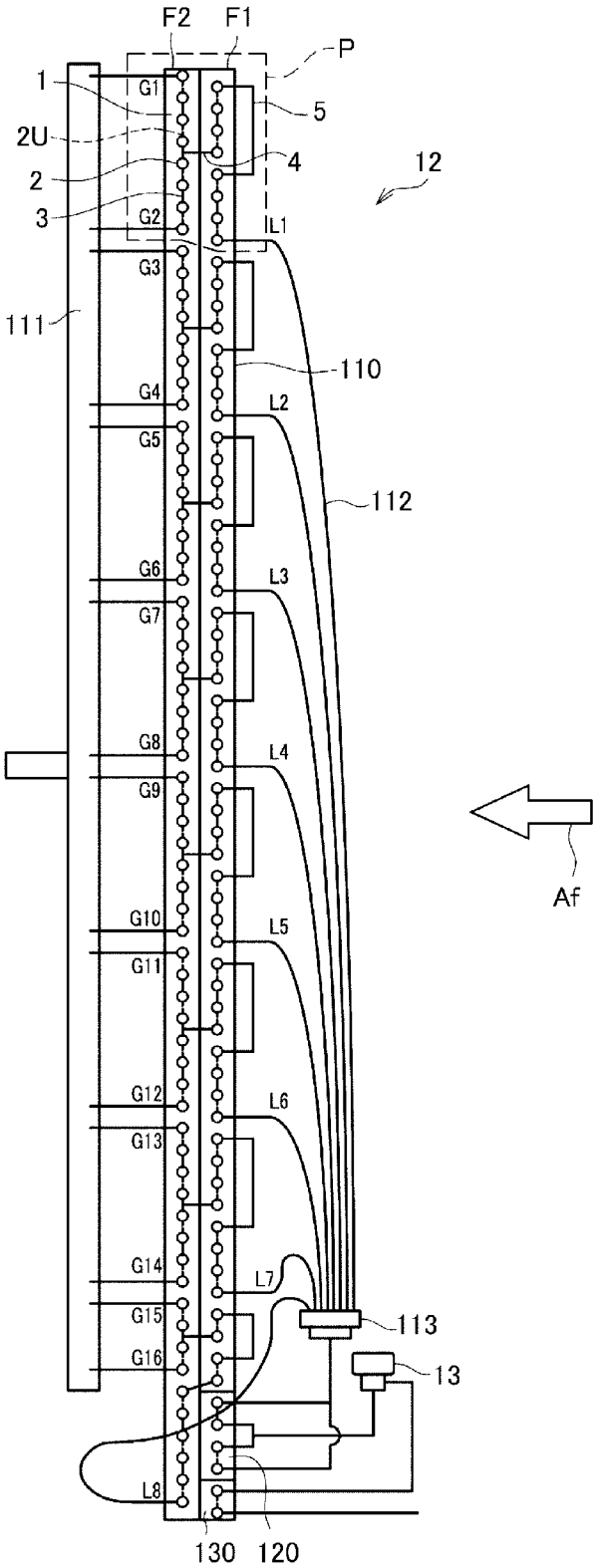

[Fig. 4]
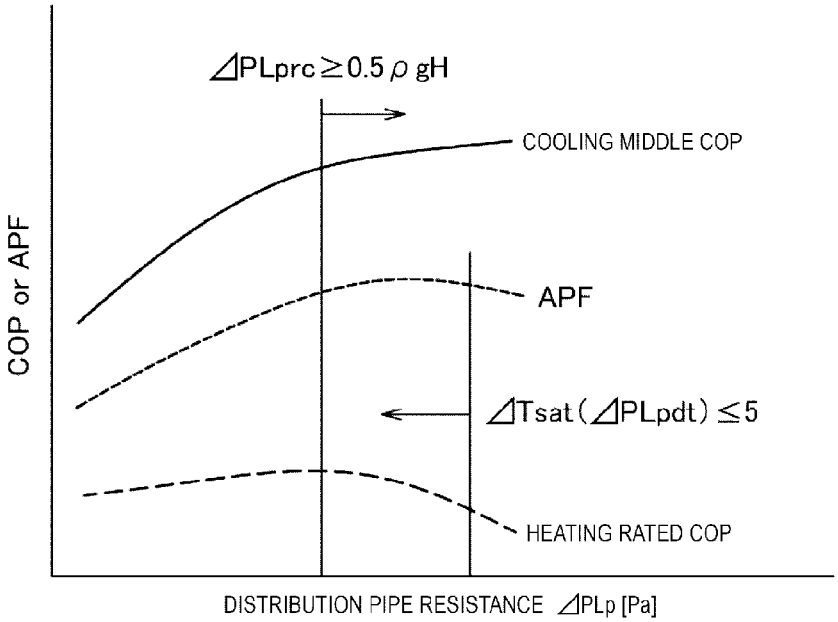
[Fig. 5]
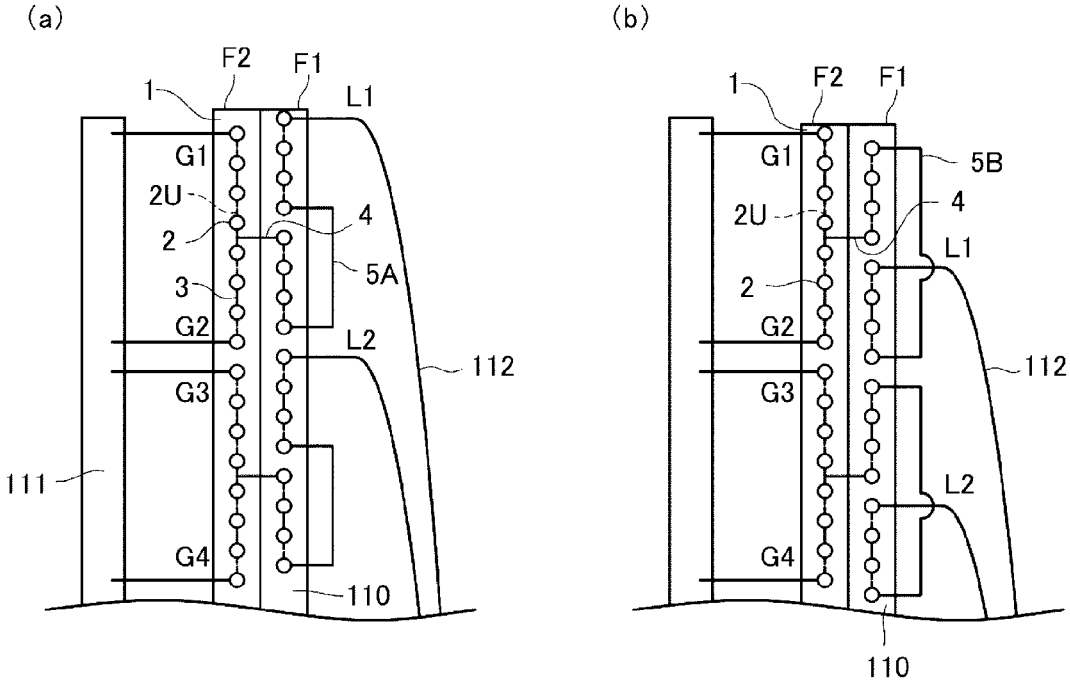

[Fig. 6]
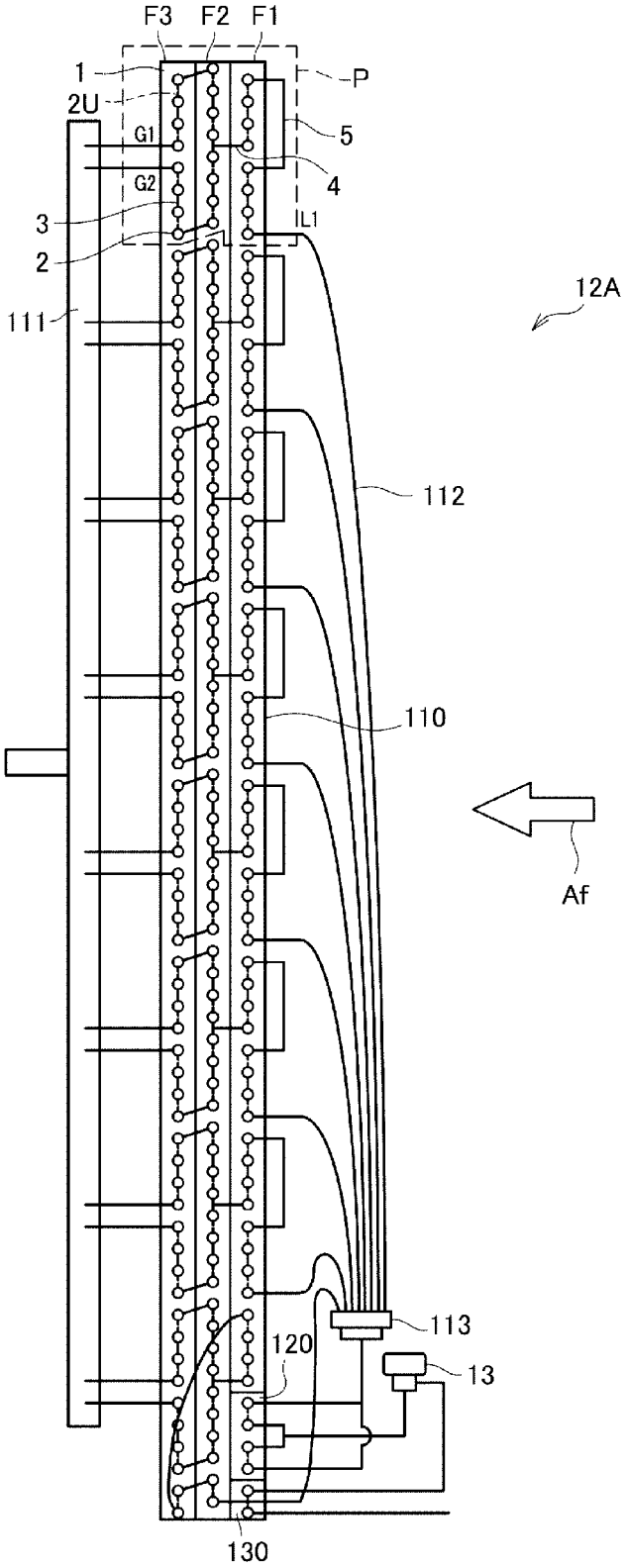

[Fig. 7]
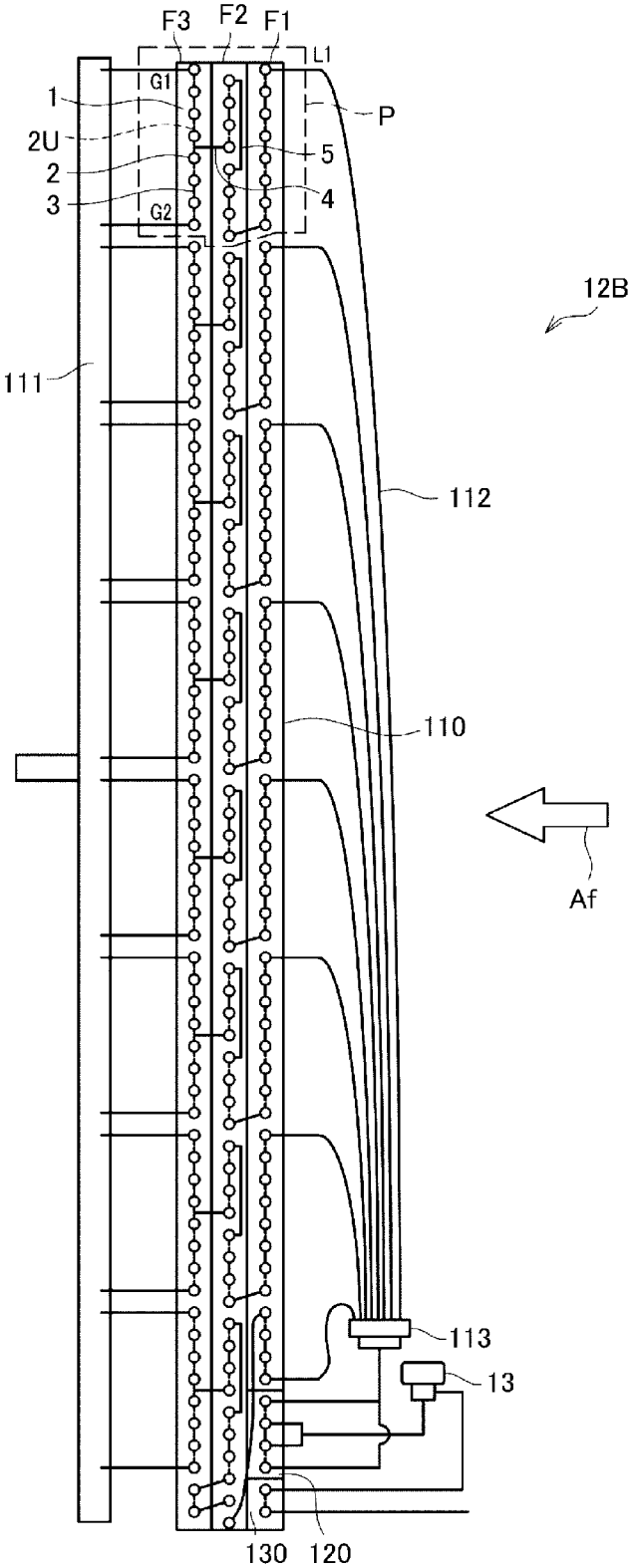

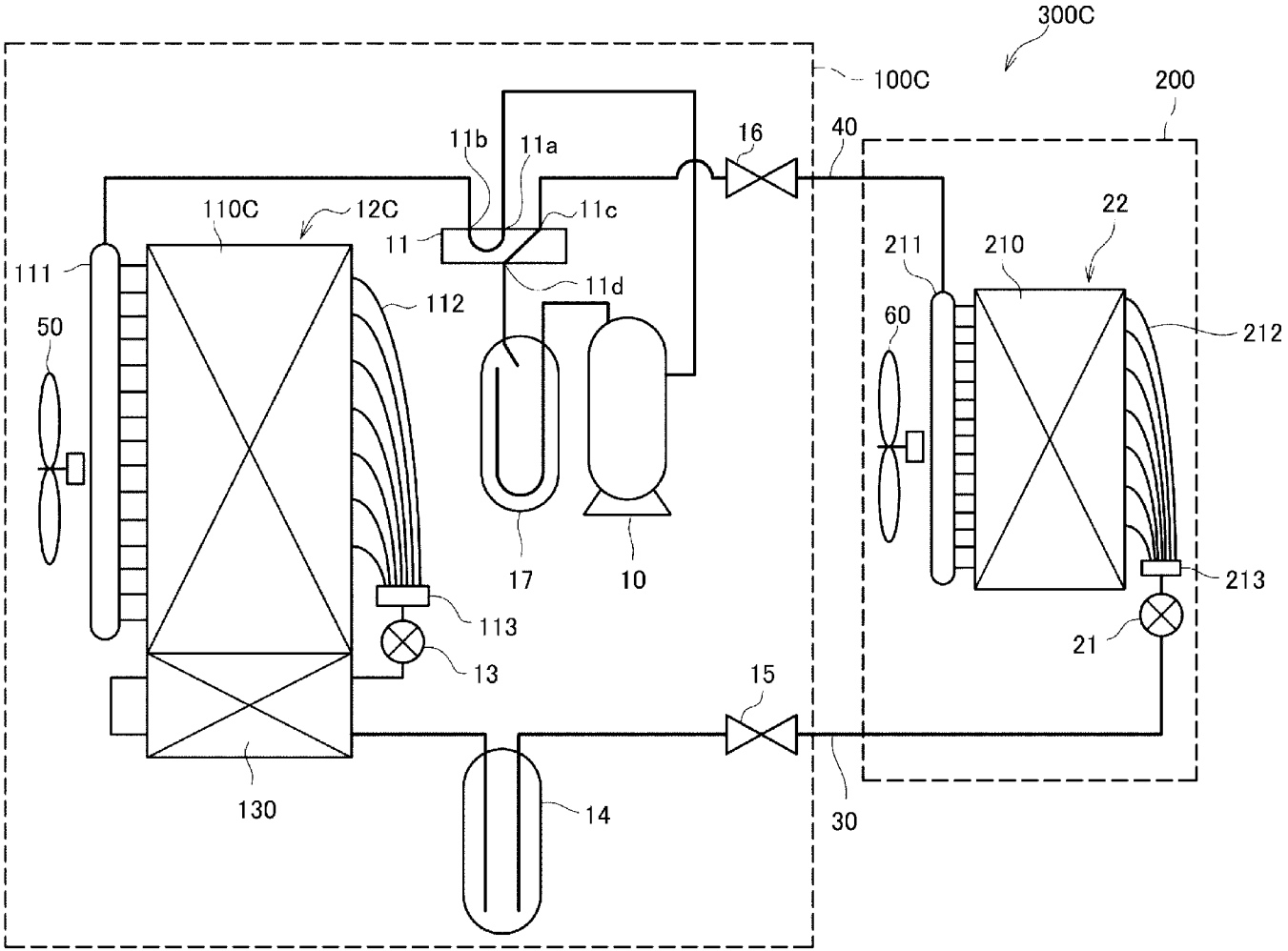
[Fig. 8]

[Fig. 9]
(a)
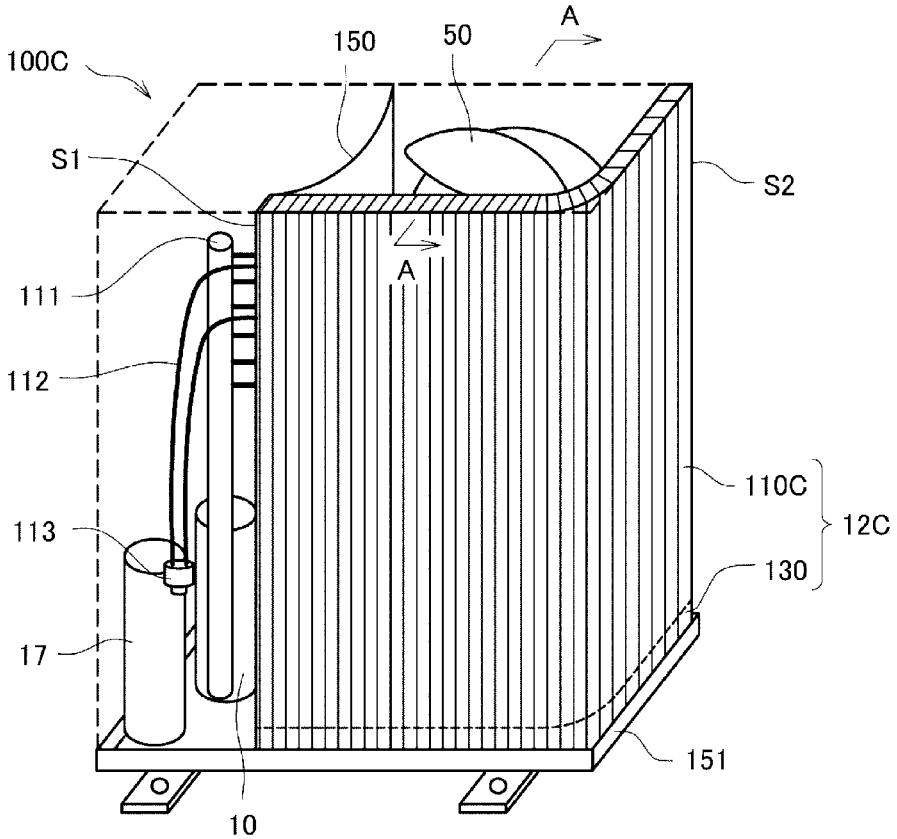
(b)
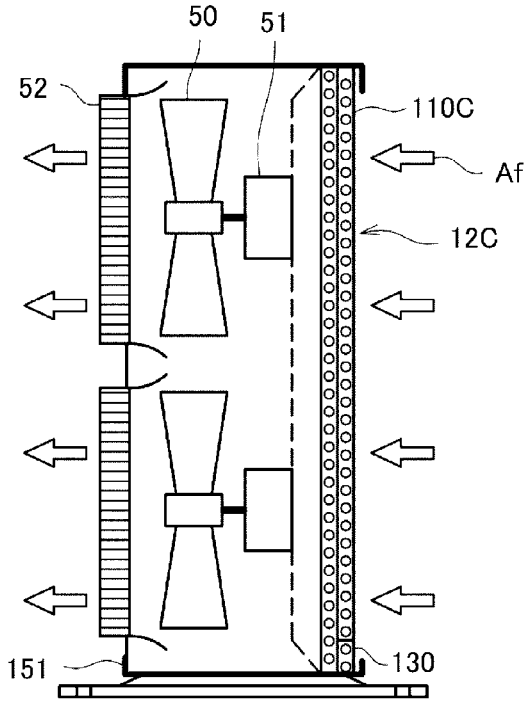

[Fig. 10]
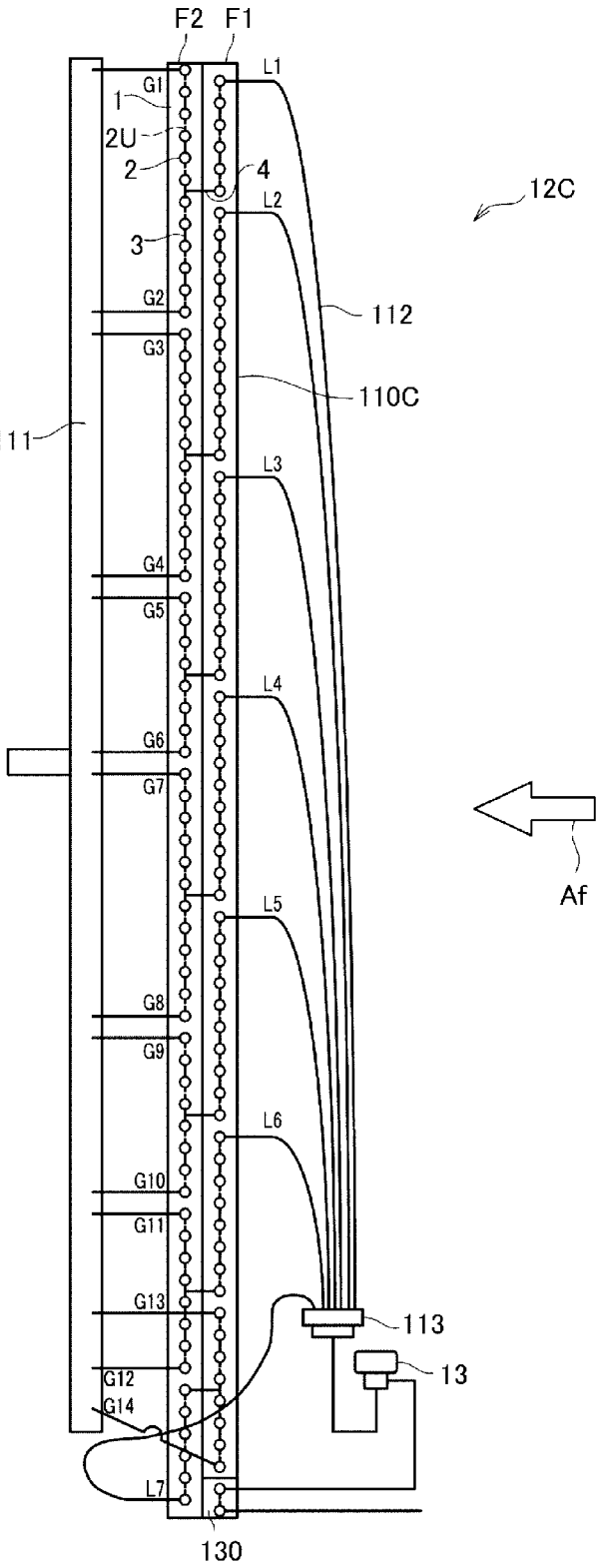

[Fig. 11]
(a) DURING COOLING OPERATION
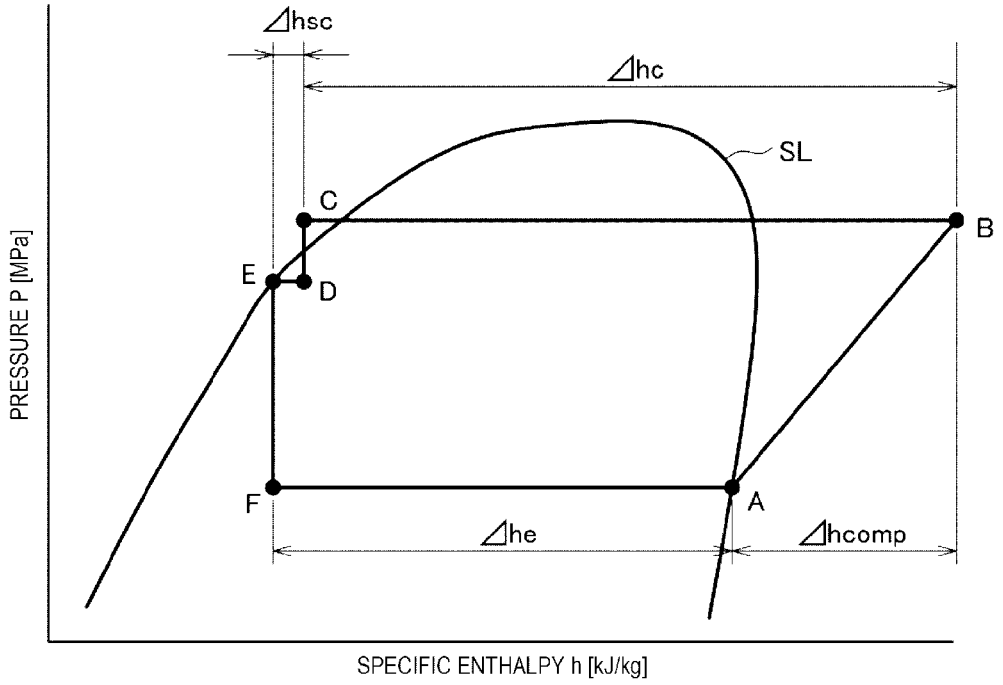
(b) DURING HEATING OPERATION
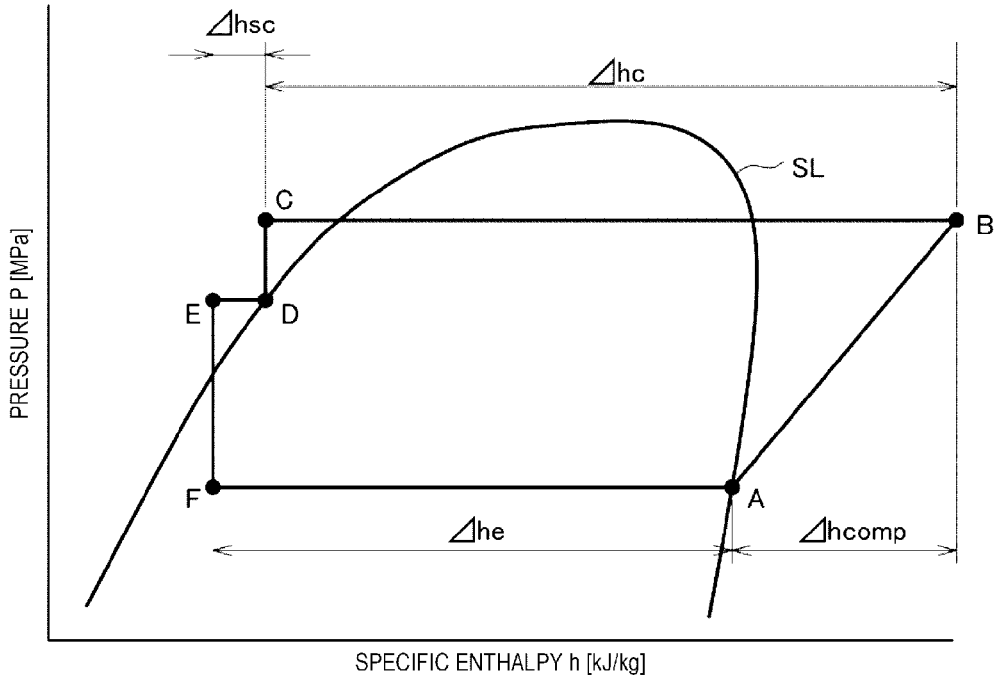

AIR-CONDITIONING DEVICE

TECHNICAL FIELD

The present invention relates to an air-conditioning device, particularly, to a heat exchanger of a heat pump type air-conditioning device.

BACKGROUND ART

Patent Document 1 (JP-A-2014-20678) is disclosed as background art in this technical field. A heat exchanger disclosed in PTL 1 is a fin and tube heat exchanger including a heat-transfer tube having a part composed of four or more paths, in order to prevent degradation of heat exchanger performance of the heat exchanger even if a refrigerant, whose temperature is significantly changed during heat release, is used. Respective paths have substantially parallel flow of the refrigerant in a stage direction, and, further, refrigerant inlets of the paths are positioned to be substantially adjacent in a case of being used as a radiator. In this manner, the description is read that it is possible to reduce the degradation of heat exchange performance, without an increase in draft resistance of an air-side circuit and an increase in manufacturing cost (refer to Abstract).

In addition, Patent Document 2 (JP-A-2011-145011) is disclosed. In order to provide an air conditioner in which a melted residue of frost is removed and it is possible to achieve high-performance heating capacity at a low cost, an air conditioner disclosed in Patent Document 2 is an air conditioner that includes a refrigeration cycle in which at least a compressor, an indoor heat exchanger, an expansion valve, and an outdoor heat exchanger are connected using a refrigerant circuit. The outdoor heat exchanger is composed of systems of refrigerant flow paths. Any inlets of the systems of refrigerant flow paths are positioned in a refrigerant flow pipe on the second stage from the uppermost stage or the uppermost stage of the outdoor heat exchanger when the outdoor heat exchanger is used as an evaporator. In this manner, the description is read that it is possible to achieve such an air conditioner (refer to Abstract).

CITATION LIST

Patent Document

Patent Document 1: JP-A-2014-20678
Patent Document 2: JP-A-2011-145011

SUMMARY OF INVENTION

Technical Problem

In the heat exchanger of the air conditioner, optimization of a refrigerant flow rate in a heat-transfer pipe enables to maintain good balance between a pressure loss and a heat-transfer coefficient on the refrigerant side, and thus it is possible to increase heat-exchange efficiency. As means thereof, a method is known, in which flow paths converge at or diverge from an intermediate position of a refrigerant flow path extending to a liquid side from a gas side. For example, in the heat exchanger disclosed in Patent Document 1, refrigerant flow paths converge at an intermediate position when the heat exchanger is used as a condenser. In this manner, the heat-transfer coefficient on the liquid side improves, and the pressure loss on the gas side is reduced when the heat exchanger is used as an evaporator such that high performance of the heat exchanger is achieved.

In addition, the following has also been known. When the heat exchanger functions as the condenser, a so-called counterflow refrigerant flow path, in which air flows in an inflow direction which is substantially opposite to a flow path direction of the refrigerant, is formed, and thereby an inlet temperature of air approximates to an outlet temperature of the refrigerant such that heat exchange is efficiently performed. For example, in the outdoor heat exchanger of the air conditioner disclosed in Patent Document 2, a flow path used in the condenser is formed in a counterflow manner.

However, in a case where both of layout disclosed in Patent Document 1 in which the refrigerant flow paths converge at an intermediate position and counterflow layout disclosed in Patent Document 2 are used, freedom of selecting the refrigerant flow paths decreases. Then, either path has to be selected, or a difference is likely to arise between flow-path lengths of the respective refrigerant flow paths. As a result, when optimization is performed on refrigerant distribution for either the case where the heat exchanger functions as the condenser or the case where the heat exchanger functions as the evaporator (in other words, when optimization is performed on the refrigerant distribution for either a cooling operation or a heating operation of the air conditioner), a problem arises in that the refrigerant distribution on the other side is degraded, and thus it is not possible to achieve the heat exchange with high efficiency.

In addition, the outdoor heat exchanger of the air conditioner disclosed in Patent Document 2 includes a subcooler that is disposed on the front side with respect to an air current in the lower portion of the heat exchanger after the liquid side of the refrigerant flow paths converge. The subcooler enables heat exchange performance to improve when the outdoor heat exchanger functions as the condenser; however, frost or ice is likely to remain in the lower portion of the heat exchanger when the outdoor heat exchanger functions as the evaporator, and thus a problem arises in drainage during heating.

An object of the present invention is to provide a high-performance air-conditioning device in which heat exchange performance of a heat exchanger improves.

Solution to Problem

In order to solve such a problem, there is provided an air-conditioning device of the present invention including: a heat exchanger that includes heat-transfer pipes, through which a refrigerant flows, and that performs heat exchange with air. The heat exchanger has one end portion and the other end portion, and the heat-transfer pipes are arranged along both ways between the one end portion and the other end portion with the heat-transfer pipes arranged side by side in a direction intersecting with a direction of flow of the air and form rows of the heat-transfer pipes. The rows of the heat-transfer pipes arranged side by side in the intersecting direction has a first row that is positioned on an upstream side in the direction of flow of the air, and a second row that is positioned neighboring to the first row in the direction of flow of the air. The heat exchanger includes a refrigerant flow path into which a gas refrigerant flows from two gas-side inlets in the second row that are positioned off from each other, when the heat exchanger functions as a condenser. The refrigerant flow path includes the refrigerant flow paths which are formed in directions respectively in which the refrigerant flow paths come close to each other while the refrigerant flow paths are arranged along both ways between the one end portion and the other end portion. The refrigerant flow paths from the two gas-side inlets converge in the one end portion, and the refrigerant flow path connects to a heat-transfer pipe in the first row from the second row. The refrigerant flow path includes a refrigerant path which is formed in a range from the same stage as one of the gas-side inlets of the second row) to the same stage as the other of the gas-side inlets of the second row, while being arranged along both ways between the one end portion and the other end portion in the first row, and the refrigerant flow path extends to a liquid-side outlet.

Advantageous Effects of Invention

According to the present invention, it is possible to provide a high-performance air-conditioning device in which heat exchange performance of a heat exchanger improves.

BRIEF DESCRIPTION OF DRAWINGS

FIG. 1 is a diagram schematically illustrating a construction of an air conditioner according to a first embodiment.

FIG. 2(*a*) is a perspective view illustrating disposition of an outdoor heat exchanger in an outdoor device of the air conditioner according to the first embodiment, and FIG. 2(*b*) is a sectional view taken along line A-A.

FIG. 3 is a layout diagram of refrigerant flow paths in the outdoor heat exchanger of the air conditioner according to the first embodiment.

FIG. 4 is a diagram illustrating an influence of flow-path resistance of a liquid-side distribution pipe on performance.

FIGS. 5(*a*) and 5(*b*) each are a modification example of the layout diagram of the refrigerant flow paths.

FIG. 6 is a layout diagram of refrigerant flow paths in an outdoor heat exchanger of an air conditioner according to a second embodiment.

FIG. 7 is a layout diagram of refrigerant flow paths in an outdoor heat exchanger of an air conditioner according to a third embodiment.

FIG. 8 is a diagram schematically illustrating an arrangement of an air conditioner according to a reference example.

FIG. 9(*a*) is a perspective view illustrating disposition of an outdoor heat exchanger in an outdoor device of the air conditioner according to the reference example, and FIG. 9(*b*) is a sectional view taken along line A-A.

FIG. 10 is a layout diagram of refrigerant flow paths in an outdoor heat exchanger of the air conditioner according to the reference example.

FIG. 11 illustrates an operational state of the air conditioner according to the reference example on a Mollier diagram: FIG. 11(*a*) illustrates a state during a cooling operation; and FIG. 11(*b*) illustrates a state during a heating operation.

DESCRIPTION OF EMBODIMENTS

Hereinafter, modes for carrying out the present invention (embodiments) will be described in detail with reference to appropriate figures. Note that, in the figures, the same reference signs are assigned to the common portions, and repeated description thereof is omitted.

Reference Example

First, before an air conditioner (air-conditioning device) 300 (refer to FIG. 1 which will be described below) according to the embodiment is described, an air conditioner 300C according to a reference example is described with reference to FIGS. 8 to 11.

FIG. 8 is a diagram schematically illustrating a construction of the air conditioner 300C according to the reference example.

As illustrated in FIG. 8, the air conditioner 300C according to the reference example includes an outdoor device 100C and an indoor device 200, and the outdoor device 100C and the indoor device 200 are connected using liquid piping 30 and gas piping 40. Note that the indoor device 200 is disposed in an indoor space (in an air-conditioned space) in which air conditioning is performed, and the outdoor device 100C is disposed in an outdoor space.

The outdoor device 100C includes a compressor 10, a four-way valve 11, an outdoor heat exchanger 12C, an outdoor expansion valve 13, a receiver 14, a liquid-stop valve 15, a gas-stop valve 16, an accumulator 17, and an outdoor fan 50. The indoor device 200 includes an indoor expansion valve 21, an indoor heat exchanger 22, and an indoor fan 60.

The four-way valve 11 has four ports 11*a* to 11*d*, the port 11*a* is connected to a discharge side of the compressor 10, the port 11*b* is connected to the outdoor heat exchanger 12C (gas header 111 which will be described below), the port 11*c* is connected to the indoor heat exchanger 22 of the indoor device 200 (gas header 211 which will be described below) using the gas-stop valve 16 and the gas piping 40, and the port 11*d* is connected to a suction side of the compressor 10 using the accumulator 17. In addition, the four-way valve 11 makes it possible to switch communications between the four ports 11*a* to 11*d*. Specifically, during a cooling operation of the air conditioner 300C, as illustrated in FIG. 8, the port 11*a* communicates with the port 11*b*, and the port 11*c* communicates with the port 11*d*. In addition, although not illustrated, during a heating operation of the air conditioner 300C, the port 11*a* communicates with the port 11*c*, and the port 11*b* communicates with the port 11*d*.

The outdoor heat exchanger 12C includes a heat exchange unit 110C and a subcooler 130 disposed under the heat exchange unit 110C.

The heat exchange unit 110C is used as a condenser during the cooling operation and is used as an evaporator during the heating operation. One side thereof (an upstream side during the cooling operation and a downstream side during the heating operation) in a flowing direction of the refrigerant is connected to the gas header 111. The other side thereof (a downstream side during the cooling operation and an upstream side during the heating operation) is connected to the outdoor expansion valve 13 using a liquid-side distribution pipe 112 and a distributor 113 intervening therebetween.

The subcooler 130 is formed below the outdoor heat exchanger 12C. One side thereof (the upstream side during the cooling operation and the downstream side during the heating operation) in the flowing direction of the refrigerant is connected to the outdoor expansion valve 13. One side thereof (the downstream side during the cooling operation and the upstream side during the heating operation) is connected to the indoor heat exchanger 22 (a distributor 213 which will be described below) of the indoor device 200 using the receiver 14, the liquid-stop valve 15, the liquid piping 30, and the indoor expansion valve 21 intervening therebetween.

The indoor heat exchanger 22 includes the heat exchange unit 210. The heat-exchange unit 210 is used as an evaporator during the cooling operation and is used as a condenser during the heating operation. One side thereof (the upstream side during the cooling operation and the downstream side during the heating operation) in the flowing direction of the refrigerant is connected to the distributor 213 using a liquid-side distribution pipe 212 intervening therebetween. The other side thereof (the downstream side during the cooling operation and the upstream side during the heating operation) is connected to the gas header 211.

Next, actuation of the air conditioner 300C according to the reference example during the cooling operation will be described. During the cooling operation, the four-way valve 11 is switched such that the port 11*a* communicates with the port 11*b*, and the port 11*c* communicates with the port 11*d*.

A high-temperature gas refrigerant discharged from the compressor 10 is sent from the gas header 111 through the four-way valve 11 (ports 11*a* and 11*b*) to the heat exchange unit 110C of the outdoor heat exchanger 12C. The high-temperature gas refrigerant flowing into the heat exchange unit 110C is subjected to heat exchange with outdoor air sent by the outdoor fan 50 and is condensed into a liquid refrigerant. Then, the liquid refrigerant passes through the liquid-side distribution pipe 112, the distributor 113, and the outdoor expansion valve 13, and then is sent to the indoor device 200 through the subcooler 130, the receiver 14, the liquid-stop valve 15, and the liquid piping 30. The liquid refrigerant sent to the indoor device 200 is subjected to pressure reduction in the indoor expansion valve 21, passes through the distributor 213 and the liquid-side distribution pipe 212, and is sent to the heat exchange unit 210 of the indoor heat exchanger 22. The liquid refrigerant flowing into the heat exchanging unit 210 is subjected to heat exchange with indoor air sent by the indoor fan 60 and is evaporated into a gas refrigerant. At this time, the indoor air cooled through the heat exchange in the heat exchange unit 210 is blown indoors by the indoor fan 60 from the indoor device 200 and indoor cooling is performed. Then, the gas refrigerant is sent to the outdoor device 100C through the gas header 211 and the gas piping 40. The gas refrigerant sent to the outdoor device 100C passes through the accumulator 17 through the gas-stop valve 16 and the four-way valve 11 (ports 11*c* and 11*d*) and flows again into and is compressed in the compressor 10.

Next, actuation of the air conditioner 300C according to the reference example during the heating operation will be described. During the heating operation, the four-way valve 11 is switched such that the port 11*a* communicates with the port 11*c*, and the port 11*b* communicates with the port 11*d*.

The high-temperature gas refrigerant discharged from the compressor 10 is sent to the indoor device 200 through the gas-stop valve 16 and the gas piping 40 through the four-way valve 11 (ports 11*a* and 11*d*). The high-temperature gas refrigerant sent to the indoor device 200 is sent from the gas header 211 to the heat exchange unit 210 of the indoor heat exchanger 22. The high-temperature gas refrigerant flowing into the heat exchange unit 210 is subjected to heat exchange with indoor air sent by the indoor fan 60 and is condensed into a liquid refrigerant. At this time, the indoor air heated through the heat exchange in the heat exchange unit 210 is blown indoors by the indoor fan 60 from the indoor device 200 and indoor heating is performed. Then, the liquid refrigerant passes through the liquid-side distribution pipe 212, the distributor 213, and the indoor expansion valve 21, and then is sent to the outdoor device 100C through the liquid piping 30. The liquid refrigerant sent to the outdoor device 100C is subjected to pressure reduction in the outdoor expansion valve 13 through the liquid-stop valve 15, the receiver 14, and the subcooler 130, passes through the distributor 113 and the liquid-side distribution pipe 112, and is sent to the heat exchange unit 110C of the outdoor heat exchanger 12C. The liquid refrigerant flowing into the heat exchange unit 110C is subjected to the heat exchange with the outdoor air sent by the outdoor fan 50 and is evaporated into a gas refrigerant. Then, the gas refrigerant passes through the accumulator 17 through the gas header 111 and the four-way valve 11 (ports 11*b* and 11*d*) and flows again into and is compressed in the compressor 10.

Here, the refrigerant is sealed in a refrigeration cycle and has a function of transmitting heat energy during the cooling operation and the heating operation. Examples of the refrigerant include R410A, R32, a mixed refrigerant containing the R32 and the R1234yf, a mixed refrigerant containing the R32 and the R1234ze (E), and the like. In the following description, a case of using R32 as the refrigerant is described; however, even in a case of using another refrigerant, it is possible to obtain the same action-effects with refrigerant properties such as a pressure loss, a heat-transfer coefficient, and a specific enthalpy, in the following description, and thus detailed description of the case of using another refrigerant is omitted.

Next, an operation state of the air conditioner 300C according to the reference example during the cooling operation will be described. FIG. 11(*a*) is a diagram illustrating the operational state of the air conditioner 300C according to the reference example during the cooling operation on a Mollier diagram.

FIG. 11(*a*) is the Mollier diagram (P-h diagram) in which the vertical axis represents pressure P and the horizontal axis represents specific enthalpy h, a curved line represented by a reference sign SL is a saturation line, and a line from a point A to a point F represents a state change of the refrigerant. Specifically, a line from the point A to a point B represents a compression actuation in the compressor 10. A line from the point B to a point C represents a condensing actuation in the heat exchange unit 110C of the outdoor heat exchanger 12C functioning as a condenser. A line from the point C to a point D represents a pressure loss through the outdoor expansion valve 13. A line from the point D to a point E represents a heat releasing actuation in the subcooler 130. A line from the point E to a point F represents a pressure reduction actuation in the indoor expansion valve 21. A line from the point F to the point A represents an evaporating actuation in the heat exchange unit 210 of the indoor heat exchanger 22 that functions as the evaporator. Thus, they compose a series of the refrigeration cycle. In addition, Δhcomp represents a specific enthalpy difference produced in the compression power in the compressor 10, Δhc represents a specific enthalpy difference produced during the condensing actuation in the condenser, Δhsc represents a specific enthalpy difference produced during the heat releasing actuation in the subcooler 130, and Δhe represents a specific enthalpy difference produced during the evaporation actuation in the evaporator.

Here, it is possible to express cooling performance Qe [kW] in Expression (1) using the specific enthalpy difference Δhe [kJ/kg] and a refrigerant circulation amount Gr [kg/s] in the evaporator. In addition, it is possible to express a performance coefficient COPe [-] during the cooling operation in Expression (2) using the specific enthalpy difference Δhe [kJ/kg] in the evaporator and the specific enthalpy difference Δhcomp [kJ/kg] produced in the compression power in the compressor 10.

$$Qe=\Delta he\cdot Gr \tag{1}$$

$$COPe=\Delta he/\Delta h\mathrm{comp} \tag{2}$$

Next, an operation state of the air conditioner 300C according to the reference example during the heating operation will be described. FIG. 11(*b*) is a diagram illustrating the operational state of the air conditioner 300C according to the reference example during the heating operation on a Mollier diagram.

As described above, during the heating operation, compared to the refrigeration cycle state during the cooling operation, the heat exchange unit 110C of the outdoor heat exchanger 12C and the heat exchange unit 210 of the indoor heat exchanger 22 are switched over each other to perform actuation as the condenser and the evaporator; however, the other types of actuation are substantially the same.

Specifically, a line from the point A to a point B represents a compression actuation in the compressor 10. A line from the point B to a point C represents a condensing actuation in the heat exchange unit 210 of the indoor heat exchanger 22 functioning as the condenser. A line from the point C to a point D represents a pressure loss through the indoor expansion valve 21. A line from the point D to a point E represents a heat releasing actuation in the subcooler 130, a line from the point E to a point F represents a pressure reduction actuation in the outdoor expansion valve 13. A line from the point F to the point A represents an evaporating actuation in the heat exchange unit 110C of the outdoor heat exchanger 12 that functions as the evaporator. Thus, they compose a series of the refrigeration cycle.

It is possible to express heating performance Qc [kW] in Expression (3), and it is possible to express the performance coefficient COPc [-] of during the heating operation in Expression (4).

$$Qc=\Delta hc\cdot Gr \tag{3}$$

$$COPc=\Delta hc/\Delta h\mathrm{comp}=1+COPe-\Delta hsc/\Delta h\mathrm{comp} \tag{4}$$

During the heating operation, in a case where a temperature of the refrigerant in the subcooler 130 is higher than an outside temperature, a heat release loss occurs with respect to the outside air. Therefore, in order to maintain the high performance coefficient COPc during the heating operation, it is necessary to reduce a heat release amount in the subcooler 130 to the smallest extent (that is, to reduce Δhsc). On the other hand, as illustrated in FIG. 8, the subcooler 130 is disposed under the heat exchange unit 110C of the outdoor heat exchanger 12C, and thus an antifreezing effect of a drain pan or an effect of accumulation prevention of frost is achieved during the heating operation.

In addition, as illustrated by comparing FIG. 11(*a*) to FIG. 11(*b*), the refrigerant has a higher pressure and a lower flow rate when the heat exchange unit 110C of the outdoor heat exchanger 12C is used as the condenser (between B to C in FIG. 11(*a*)) than when the heat exchange unit 110C of the outdoor heat exchanger 12C is used as the evaporator (between F to A in FIG. 11(*b*)). Therefore, the pressure loss is relatively reduced, and a surface heat-transfer coefficient is reduced. Therefore, in the air conditioner 300C that switches between the cooling operation and the heating operation, the number of diverging flow paths of the heat exchange unit 110C is set such that a refrigerant circulation amount per flow path of the heat exchange unit 110C strikes balance between both of the cooling and the beating.

<Outdoor Heat Exchanger 12C>

As described above, in order to achieve high efficiency of the heat exchanger, a method of converging or diverging the refrigerant flow paths at an intermediate position through the heat exchanger is adopted. A construction of the outdoor heat exchanger 12C of the air conditioner 300C according to the reference example is redescribed with reference to FIGS. 9 and 10. FIG. 9(*a*) is a perspective view illustrating disposition of the outdoor heat exchanger 12C in the outdoor device 100C of the air conditioner 300C according to the reference example, and FIG. 9(*b*) is a sectional view taken along line A-A.

As illustrated in FIG. 9(*a*), the inside of the outdoor device 100C is partitioned by a partition plate 150. The outdoor heat exchanger 12C, the outdoor fan 50, and the outdoor fan motor 51 (refer to FIG. 9(*b*)) are disposed in one chamber (on the right side in FIG. 9(*a*)). The compressor 10, the accumulator 17, and the like are disposed in the other chamber (on the left side in FIG. 9(*a*)).

The outdoor heat exchanger 12C is mounted on the drain pan 151 and is disposed to be bent in an L shape along two sides of a housing. In addition, as illustrated in FIG. 9(*b*), arrow Af represents flow of outdoor air. The outdoor air Af suctioned into the inside of the outdoor device 100C by the outdoor fan 50 passes through the outdoor heat exchanger 12C and is discharged to the outside of the outdoor device 100C from a vent 52.

FIG. 10 is a layout diagram of refrigerant flow paths in the outdoor heat exchanger 12C of the air conditioner 300C according to the reference example. FIG. 10 is a diagram obtained when viewing one end side S1 (refer to FIG. 9(*a*)) of the outdoor heat exchanger 12C.

The outdoor heat exchanger 12C includes a fin 1, heat-transfer pipes 2 that have a turning portion 2U and are arranged along both ways in the horizontal direction, U-bends 3, and three-way bents 4 as converging portions of the refrigerant flow paths. In addition, FIG. 10 illustrates a case where the outdoor heat exchanger 12C has two rows (a first row F1 and a second row F2) of the heat-transfer pipes 2 arranged in a flowing direction of the outdoor air Af. In addition, the heat-transfer pipes 2 have a zigzag arrangement with the first row F1 and the second row F2. In addition, as illustrated in FIG. 10, when the heat exchange unit 110C of the outdoor heat exchanger 12C is used as the condenser (that is, during the cooling operation of the air conditioner 300C) with respect to the flow of the outdoor air Af that flows from right to left, the flow of the refrigerant is from left (the gas header 111 side) to right (the distributor 113 side) and thus the flows become pseudo counterflow. The zigzag arrangement means, in a type of arrangement of the heat-transfer pipes 2, an arrangement of the heat-transfer pipes in which the heat-transfer pipes 2 are aligned at alternate positions at a half pitch between the two heat-transfer pipes 2.

When the heat exchange unit 110C of the outdoor heat exchanger 12C is used as the condenser (that is, during the cooling operation of the air conditioner 300C), gas refrigerants that flow in from gas-side inlets G1 and G2 of the second row F2 circulate through the heat-transfer pipe 2 while flowing along both ways in the horizontal direction between the one end portion S1 (refer to FIG. 9(*a*)) and the other end portion S2 (refer to FIG. 9(*a*)) of the outdoor heat exchanger 12C which is bent in the L shape.

At this time, in the one end portion S1 (refer to FIG. 9(*a*)), one end portion of the heat-transfer pipe 2 and one end portion of another heat-transfer pipe 2 neighboring in the same row (second row F2) are connected to each other by brazing the U-bend 3 that is bent in the U shape. In addition, in the other end portion S2 (refer to FIG. 9(*a*)), the refrigerant flow path has the turning portion 2U (illustrated in a dashed line in FIG. 10) having a structure in which the heat-transfer pipe 2 is bent in a hair-pin shape such that no brazed portions are formed. In this manner, the refrigerant flow path is formed.

In this manner, the gas refrigerants that flow in from the gas-side inlets G1 and G2 flow in directions (in a downward direction by the refrigerant from the gas-side inlet G1 and in an upward direction by the refrigerant from the gas-side inlet G2) in which the refrigerants come close to each other in a vertical direction while flowing along both ways through the heat-transfer pipes 2 in the horizontal direction, and come to positions which are neighboring to each other up and down. Then, the refrigerants converge in the three-way bend 4 and flow to the heat-transfer pipe 2 of the first row F1 positioned on the upstream side of the outdoor air Af. The three-way bend 4 connects, by brazing, end portions of the two heat-transfer pipes 2 of the second row F2 to one end portion of one heat-transfer pipe 2 of the first row F1, and a converging portion of the refrigerant flow paths is formed.

The refrigerant that flows into the heat-transfer pipe 2 of the first row F1 from the three-way bend 4 flows upward to the liquid-side distribution pipe 112 through a liquid-side outlet L1 while flowing along both ways in the heat-transfer pipe 2 in the horizontal direction. In the following description, a refrigerant flow path from the two gas-side inlets (G1 and G2) from which flowing-in is performed, through the three-way bend 4 in which converging is performed, to one liquid-side outlet (L1) from which flowing-out is performed, is referred to as a "path". The liquid refrigerant that flows to the liquid-side distribution pipe 112 and another liquid refrigerant from another path in the distributor 113 converge, come to the outdoor expansion valve 13 and the subcooler 130, and circulate to the receiver 14.

Here, as illustrated in FIG. 10, a refrigerant flow path from gas-side inlets G3 and G4 to a liquid-side outlet L2 is longer in a refrigerant flow path in the first flow F1 on the liquid side, compared to the refrigerant flow path from the gas-side inlets G1 and G2 to the liquid-side outlet L1. In addition, a refrigerant flow path from gas-side inlets G5 and G6 to a liquid-side outlet L3 is shorter in a refrigerant flow path in the second flow F2 on the gas side, compared to the refrigerant flow path from the gas-side inlets G1 and G2 to the liquid-side outlet L1.

In this manner, in the outdoor heat exchanger 12C (heat exchange unit 110C) of the air conditioner 300C according to the reference example, in a case where the counterflow arrangement and the converging at an intermediate position are both performed, a problem arises in that it is difficult to have equal lengths of the refrigerant flow paths in the paths. Therefore, it is not possible to set optimal refrigerant distribution in both of the cooling operation and the heating operation, and, in a case where the flow-path resistance of the liquid-side distribution pipe 112 is set to have equal outlet specific enthalpy of one operation (for example, the heating operation), it is likely to have a difference between respective refrigerant flow paths in the paths in specific enthalpy (a temperature or a degree of dryness of the refrigerant) of the other operation (for example, the cooling operation). As a result, effects of the outdoor heat exchanger 12C (the heat exchange unit 110C) are reduced.

In addition, as described above, in order to maintain the high performance coefficient COPc during the heating operation, it is desirable to reduce the heat release amount in the subcooler 130 to the smallest extent. Therefore, the subcooler 130 is disposed in the first row F1 on the upstream side in the flowing direction of the outdoor air Af, a liquid-side outlet L7 is disposed at a position in the second row F2 on the downstream side, which corresponds to a position at which the subcooler 130 is disposed, and thus heat energy released from the subcooler 130 is efficiently collected through a path flowing from the liquid-side outlet L7 to gas-side inlets G13 and G14.

However, in the outdoor heat exchanger 12C (heat exchange unit 110C) of the air conditioner 300C according to the reference example illustrated in FIG. 10, the lowermost path (path flowing from the gas-side inlets G13 and G14 to the liquid-side outlet L7) is not disposed in a counterflow manner, during the heating operation, there is a problem of improving cooling performance.

First Embodiment

Next, the air conditioner 300 according to a first embodiment will be described with reference to FIGS. 1 to 4. FIG. 1 is a diagram schematically illustrating a construction of air conditioner 300 according to the first embodiment. FIG. 2(*a*) is a perspective view illustrating disposition of an outdoor heat exchanger 12 in an outdoor device 100 of the air conditioner 300 according to the first embodiment, and FIG. 2(*b*) is a sectional view taken along line A-A.

The air conditioner 300 (refer to FIGS. 1 and 2) according to the first embodiment has a different construction of the outdoor device 100, compared to the air conditioner 300C (refer to FIGS. 8 and 9) according to the reference example. Specifically, there is a difference in that the outdoor device 100C of the reference example includes the outdoor heat exchanger 12C that is provided with the heat exchange unit 110C and the subcooler 130, but the outdoor device 100 of the first embodiment includes the outdoor heat exchanger 12 that is provided with a heat exchange unit 110, a subcooler 120, and the subcooler 130. The other construction is the same, and the repeated description thereof is omitted.

The outdoor heat exchanger 12 includes the heat exchange unit 110, the subcooler 120 provided under the heat exchange unit 110, and the subcooler 130 provided under the subcooler 120.

The heat exchange unit 110 is used as the condenser during the cooling operation and is used as the evaporator during the heating operation. One side thereof (the upstream side during the cooling operation and the downstream side during the heating operation) in the flowing direction of the refrigerant is connected to the gas header 111. The other side thereof (the downstream side during the cooling operation and the upstream side during the heating operation) is connected to the distributor 113 using the liquid-side distribution pipe 112.

The subcooler 120 is formed below the outdoor heat exchanger 12 and above the subcooler 130. One side thereof (the upstream side during the cooling operation and the downstream side during the heating operation) in the flowing direction of the refrigerant is connected to the distributor 113, outdoor expansion valve 13. The other side thereof (the downstream side during the cooling operation and the upstream side during the heating operation) is connected to the outdoor expansion valve 13.

The subcooler 130 is formed below the subcooler 120 under the outdoor heat exchanger 12. One side thereof (the upstream side during the cooling operation and the downstream side during the heating operation) in the flowing direction of the refrigerant is connected to the outdoor expansion valve 13. The other side thereof (the downstream side during the cooling operation and the upstream side during the heating operation) is connected to the indoor heat exchanger 22 (the distributor 213 which will be described below) of the indoor device 200 using the receiver 14, the liquid-stop valve 15, the liquid piping 30, and the indoor expansion valve 21.

In such a construction, during the cooling operation of the air conditioner 300, the high-temperature gas refrigerant flowing into the heat exchange unit 110 from the gas header 111 is subjected to the heat exchange with outdoor air sent by the outdoor fan 50 and is condensed into the liquid refrigerant. Then, the liquid refrigerant passes through the liquid-side distribution pipe 112, the distributor 113, the subcooler 120, and the outdoor expansion valve 13, and then is sent to the indoor device 200 through the subcooler 130, the receiver 14, the liquid-stop valve 15, and the liquid piping 30.

In addition, during the heating operation of the air conditioner 300, the liquid refrigerant sent to the outdoor device 100 from the indoor device 200 through the liquid piping 30 is subjected to pressure reduction in the outdoor expansion valve 13 through the liquid-stop valve 15, the receiver 14, and the subcooler 130, passes through the subcooler 120, the distributor 113, and the liquid-side distribution pipe 112, and is sent to the heat exchange unit 110 of the outdoor heat exchanger 12. The liquid refrigerant flowing into the heat exchange unit 110 is subjected to the heat exchange with the outdoor air sent by the outdoor fan 50, is evaporated into a gas refrigerant, and is sent to the gas header 111.

<Outdoor Heat Exchanger 12>

A construction of the outdoor heat exchanger 12 of the air conditioner 300 according to the first embodiment is redescribed with reference to FIG. 3. FIG. 3 is a layout diagram of refrigerant flow paths in the outdoor heat exchanger 12 of the air conditioner 300 according to the first embodiment. FIG. 3 is a diagram obtained when viewing one end side S1 (refer to FIG. 2(*a*)) of the outdoor heat exchanger 12.

The outdoor heat exchanger 12 includes a fin 1, the heat-transfer pipes 2 that have the turning portion 2U and are arranged along both ways in the horizontal direction, U-bends 3, three-way bents 4 as converging portions of the refrigerant flow paths, and the connection pipes 5. Similar to the outdoor heat exchanger 12C (refer to FIG. 10) of the reference example, the outdoor heat exchanger 12 has an arrangement in which two rows (first row F1 and second row F2) of the heat-transfer pipes 2 are arranged, and the heat-transfer pipes 2 have zigzag arrangement having the first row F1 and the second row F2. In the arrangement, the flow of the refrigerant and the flow of the outdoor air Af are pseudo counterflow when the heat exchange unit 110 of the outdoor heat exchanger 12 is used as the condenser (that is, during the cooling operation of the air conditioner 300).

Flow of the refrigerant in the first path (path flowing from the gas-side inlets G1 and G2 to the liquid-side outlet L1) of the outdoor heat exchanger 12 (heat exchange unit 110) is described. The gas refrigerants that flow in from the gas-side inlets G1 and G2 flow in directions (in a downward direction by the refrigerant from the gas-side inlet G1 and in an upward direction by the refrigerant from the gas-side inlet G2) in which the refrigerants come close to each other in a vertical direction while flowing along both ways through the heat-transfer pipes 2 in the horizontal direction, and come to positions which are neighboring to each other up and down. Then, the refrigerants converge in the three-way bend 4 and flow to the heat-transfer pipe 2 of the first row F1 positioned on the upstream side of the outdoor air Af.

The refrigerant that flows into the heat-transfer pipe 2 of the first row F1 from the three-way bend 4 flows upward while flowing along both ways through the heat-transfer pipe 2 in the horizontal direction, and flows through the connection pipe 5 at the same stage as the gas-side inlet G1 (a position lower than the gas-side inlet G1 by a half pitch, since the heat-transfer pipes 2 have the zigzag arrangement in the first row F1 and the second row F2) to a heat-transfer pipe 2 which is immediately below the heat-transfer pipe 2 of the first row F1 that is connected to the three-way bend 4. The connection pipe 5 connects, by brazing, one end of the heat-transfer pipe 2 of the first row F1 in the same stage as the gas-side inlet G1 to one end of the heat-transfer pipe 2 which is immediately below the heat-transfer pipe 2 of the first row F1 that is connected to the three-way bend 4 and forms a refrigerant flow path.

The refrigerant that flows into the heat-transfer pipe 2 from the connection pipe 5 flows downward while flowing along both ways through the heat-transfer pipe 2 in the horizontal direction, and flows to the liquid-side distribution pipe 112 in the liquid-side outlet L1 at the same stage as the gas-side inlet G2 (a position lower than the gas-side inlet G2 by a half pitch, since the heat-transfer pipes 2 have the zigzag arrangement in the first row F1 and the second row F2).

In other words, the number of times of arrangement of the heat-transfer pipe 2 along both ways from the gas-side inlet G1 to the three-way bent 4 in the horizontal direction, the number of times of arrangement of the heat-transfer pipe 2 along both ways from the gas-side inlet G2 to the three-way bent 4 in the horizontal direction, the number of times of arrangement of the heat-transfer pipe 2 along both ways from the three-way bent 4 to the connection pipe 5 in the horizontal direction, and the number of times of arrangement of the heat-transfer pipe 2 along both ways from the connection pipe 5 to the liquid-side outlet L1 in the horizontal direction are all equal.

Then, the liquid refrigerant that flows to the liquid-side distribution pipe 112 and another liquid refrigerant from another path in the distributor 113 converge, come to the subcooler 120, the outdoor expansion valve 13 and the subcooler 130, and circulate to the receiver 14.

The second path (path flowing from the gas-side inlets G3 and G4 to the liquid-side outlet L2) of the outdoor heat exchanger 12 is the same refrigerant flow path as the first path (path flowing from the gas-side inlets G1 and G2 to the liquid-side outlet L1). The same is true of the following paths, and the outdoor heat exchanger 12 (heat exchange unit 110) includes a plurality of (seven in an example in FIG. 3) the refrigerant flow paths which are the same as in the first path.

In such an arrangement, in the outdoor heat exchanger 12 (heat exchange unit 110) of the air conditioner 300 according to the first embodiment, it is possible to have both of the counterflow arrangement and the converging at an intermediate position, and thus it is possible to have equal lengths of the refrigerant flow paths in the paths. In this manner, it is possible to set the flow-path resistance of the liquid-side distribution pipe 112 so as to achieve the optimal refrigerant distribution in both of the cooling operation and the heating operation.

In other words, in the heating operation, when the flow-path resistance of the liquid-side distribution pipe 112 is set depending on the outlet specific enthalpy, it is not necessary to have a difference between the flow-path differences in the liquid-side distribution pipes 112 in the path since the refrigerant flow paths in the paths are the same. Therefore, in the cooling operation, a difference is prevented from occurring between values of the specific enthalpy (temperatures or degrees of dryness of the refrigerants) of the refrigerant flow paths in the paths due to the difference between the flow-path resistances of the liquid-side distribution pipes 112 and heat exchange efficiency is prevented from be lowered. In this manner, it is possible to improve the performance of the air conditioner 300 in both of the cooling operation and the heating operation.

In addition, the three-way bend 4 is used as a diverging portion of the refrigerant flow path of the paths during the heating operation. During the heating operation in which the heat exchange unit 110 of the outdoor heat exchanger 12 is used as the evaporator, the liquid refrigerant flowing from the liquid-side outlet L2 is subjected to the heat exchange with the outdoor air in the first row F1 of the outdoor heat exchanger 12 and becomes a gas-liquid mixed refrigerant. In three-way portions in the three-way bend 4, when viewed from a side connected to the end portion of the heat-transfer pipe 2 of the first row F1, a shape of the refrigerant flow path of the diverging portion to the side connected to end portions of two heat-transfer pipes 2 of the second row F2 is a symmetrical shape (right-left even shape) (not illustrated). In this manner, the refrigerant collides with the three-way portions of the three-way bend 4 and diverges therein, and thereby the ratios of the liquid refrigerant and the gas refrigerant of the refrigerant flowing from the gas-side inlet G1 and the gas-side inlet G2 are equal. Thus, it is possible to obtain substantially equal degrees of dryness or values of specific enthalpy in outlet portions of the evaporator. In this manner, the heat exchange performance increases during the heating operation, and thus it is possible to achieve the highly efficient air conditioner 300.

In addition, for example, the heat exchanger disclosed in Patent Document 1 has an arrangement in which three-way piping having piping that connects from a position slightly below from the middle position of the heat exchanger to the top stage, and the three-way portion diverging at the end of the piping is connected to heat-transfer pipes (refer to FIG. 1 in PTL 1). With such an arrangement, first, the three-way portion and the piping are connected by the brazing at a high melting temperature so as to prepare the three-way piping, and then it is necessary to connect the heat-transfer pipes and the three-way piping with a brazing material having a low melting temperature. Therefore, reliability of goods is likely to be degraded due to an increase in man hours, an occurrence of gas leakage defects by remelting of a brazed portion between the three-way portion and the piping. By comparison, in the outdoor heat exchanger 12 of the first embodiment, it is possible to manufacture the outdoor heat exchanger 12 by brazing the U-bend 3, the three-way bend 4, and connection pipe 5 to the heat-transfer pipes 2 such that it is possible to improve the heat exchange performance, to reduce the man hours of the manufacturing, and to achieve improvement of the reliability.

In addition, as illustrated in FIGS. 1 and 3, the outdoor heat exchanger 12 of the air conditioner 300 according to the first embodiment includes the subcooler 120, and the subcooler 120 is disposed between the distributor 113 and the outdoor expansion valve 13 in the flowing direction of the refrigerant. In other words, the outdoor expansion valve 13 is disposed between the subcooler 120 and the subcooler 130.

In such an arrangement, during the cooling operation of the air conditioner 300, the liquid refrigerants flowing from the paths of the heat exchange unit 110 converge in the distributor 113 and flow to the subcooler 120. In this manner, a flow rate of the refrigerant increases and a refrigerant-side heat-transfer coefficient increases, and thereby the heat exchange performance of the outdoor heat exchanger 12 improves and the performance of the air conditioner 300 improves.

In addition, during the heating operation of the air conditioner 300, the liquid refrigerant that is subjected to the pressure reduction in the outdoor expansion valve 13 and a decrease in the refrigerant temperature flows into the subcooler 120. In this manner, a heat release amount in the subcooler 120 decreases, and thus it is possible to improve the performance coefficient COPc during the heating operation. The temperature of the refrigerant that flows to the subcooler 120 is lower than an outside temperature of the outdoor air Af during the heating operation, and thereby it is possible to preferably reduce the heat release amount in the subcooler 120.

In addition, as illustrated in FIG. 3, the subcooler 120 and the subcooler 130 are provided in the first row F1 of the outdoor heat exchanger 12, and the subcooler 130 is provided at the lowermost stage and the subcooler 120 is provided thereon.

Here, the eighth path (path flowing from gas-side inlets G15 and G16 to a liquid-side outlet L8) of the outdoor heat exchanger 12 (heat exchange unit 110) has a first heat exchange region of the second row F2 from the gas-side inlets G15 and G16 to the three-way bent 4 in which converging is performed, a second heat exchange region of the first row F1 to which the connection pipe 5 is connected to an intermediate position thereof at the same stage (here, shifted by a half pitch for the zigzag arrangement) as the first heat exchange region, and a third heat exchange region of the second row F2 at the same stage (here, shifted by the half pitch for the zigzag arrangement) as the subcoolers 120 and 130.

According to such an arrangement, during the cooling operation of the air conditioner 300, the flow of the refrigerant and the flow of the outdoor air Af become the pseudo counterflow in the first heat exchange region and the second heat exchange region. Although the third heat exchange region is formed in the second row F2, the subcoolers 120 and 130 are provided at the same stage in the first row F1, the liquid refrigerant flows into the subcoolers 120 and 130 after the liquid refrigerant has been subjected to the heat exchange in the heat exchange unit 110. Therefore, the flow of the refrigerant also in the third heat exchange region and the flow of the outdoor air Af become the pseudo counterflow. In addition, a liquid-side outlet L8 of the eighth path is provided on the downstream side of the subcooler 130 in the flowing direction of the outdoor air Af, and thereby the heat energy released from the subcooler 130 is efficiently collected in the third heat exchange region of the eighth path during the heating operation of the air conditioner 300. In this manner, it is possible to improve the performance of the air conditioner 300 in both of the cooling operation and the heating operation.

In addition, in the first row F1 of the outdoor heat exchanger 12, the heat exchange unit 110, the subcooler 120, and the subcooler 130 are aligned in this order when viewed in the vertical direction. With such disposition, during the heating operation, it is possible to dispose the subcooler 120 actuated at an intermediate temperature between the heat exchange unit 110 functioning as the evaporator and the subcooler 130 having a high temperature with an aim of preventing the drain pan from freezing or the like, and thus it is possible to reduce a heat conduction loss through the fin 1. Similarly, during the cooling operation, it is possible to dispose the subcooler 120 actuated at an intermediate temperature between the heat exchange unit 110 functioning as the condenser and the subcooler 130 through which the liquid refrigerant is subjected to the heat exchange in the heat exchange unit 110, is subjected to pressure reduction in the outdoor expansion valve 13, and flows to have a low temperature, and thus it is possible to reduce a heat conduction loss through the fin 1.

<Liquid-Side Distribution Pipe>

Next, the flow-path resistance (pressure loss) of the liquid-side distribution pipe 112 that connects the liquid-side outlets (L1, L2, and . . . ) of the paths of the heat exchange unit 110 and the distributor 113 will be described.

It is desirable that the flow-path resistance (pressure loss) of the liquid-side distribution pipe 112 is set to converge in a range of ±20% for each distribution pipe of the paths.

Here, it is possible to express flow-path resistance ΔPLp [Pa] of the liquid-side distribution pipe 112 in Expression (5) using a pipe friction coefficient λ [-] of the liquid-side distribution pipe 112, a length L [m] of the liquid-side distribution pipe 112, an inner diameter d [m] of the liquid-side distribution pipe 112, refrigerant density ρ [kg/m$^3$), and a refrigerant flow rate u [m/s]. In addition, it is possible to express the pipe friction coefficient λ [-] in Expression (6) using a Reynolds number Re H. In addition, it is possible to express the Reynolds number Re [-] in Expression (7) using the refrigerant flow rate u [m/s], the inner diameter d [m] of the liquid-side distribution pipe 112, and a dynamic viscosity coefficient ν [Pa·s].

$$\Delta PLp=\lambda\cdot(L/d)\cdot\rho u^2/2 \quad (5)$$

$$\lambda=0.3164\cdot Re^{-0.25} \quad (6)$$

$$Re=ud/\nu \quad (7)$$

In other words, it is desirable that the flow-path resistance ΔPlp of the liquid-side distribution pipe 112 that is obtained from Expression (5) is set to converge in a range of ±20% for each distribution pipe of the paths. Expression (5) is arranged by the length L [m] of the liquid-side distribution pipe 112 and the inner diameter d [m] of the liquid-side distribution pipe 112, and thereby it is desirable that the pressure-loss coefficient ΔPc expressed in the following Expression (8) is set to converge in a range of ±20% for each distribution pipe of the paths.

$$\Delta Pc=L/d^{5.25} \quad (8)$$

As illustrated in FIG. 2(*b*), in the outdoor device 100 in which the air is blown with respect to the outdoor heat exchanger 12 in the horizontal direction, substantially uniform vertical distribution of blow rate is obtained. In addition, as illustrated in FIG. 3, the heat exchange unit 110 of the outdoor heat exchanger 12 includes the refrigerant flow paths which are the same as in the first path. According to such an arrangement, even when the flow-path resistance of the liquid-side distribution pipe 112 is not significantly adjusted (that is, adjusted in the range of ±20%), it is possible to obtain uniform refrigerant distribution. Further, a difference between the flow-path resistances of the liquid-side distribution pipes 112 is reduced (converges in the range of ±20%), a difference between the refrigerant distribution is unlikely to occur in both of the cooling operation and the heating operation.

In addition, it is desirable that the flow-path resistance (pressure loss) of the liquid-side distribution pipe 112 is set to be 50% or higher of a liquid head difference occurring due to a height dimension H [m] of the heat exchanger. In other words, when distribution-pipe resistance during an operation with cooling middle performance (performance of about 50% of rated performance) is ΔPLprc, it is desirable to satisfy Expression (9). Note that ρ represents refrigerant density [kg/m$^3$], and g represents gravitational acceleration [kg/s$^2$].

$$\Delta PLprc\geq 0.5\ \rho gH \quad (9)$$

In this manner, the performance is reduced to about 50% of the rated performance during the cooling operation, and it is possible to prevent deterioration of the refrigerant distribution due to the liquid head difference even during the operation in which the refrigerant pressure loss of the condenser is reduced, and it is possible to improve COP during the operation with the cooling middle performance.

Further, in a case where the height dimension H [m] of the heat exchanger is 0.5 m or higher, the satisfaction of Expression (9) is more effective because an effect of improving efficiency during the operation with the cooling middle performance increases. This is because, in a case where the height dimension H [m] of the heat exchanger is 0.5 m or higher, the head difference occurring on the refrigerant side increases, and the performance is likely to be degraded due to the distribution deterioration; however, the satisfaction of Expression (9) enables to appropriately prevent deterioration of the refrigerant distribution and it is possible to improve the COP during the operation with the cooling middle performance.

FIG. 4 is a diagram illustrating an influence of the flow-path resistance of the liquid-side distribution pipe 112 on performance in the construction of the air conditioner 300 according to the first embodiment. In FIG. 4, the horizontal axis of the graph represents the flow-path resistance of the liquid-side distribution pipe 112, the vertical axis represents the COP during the operation of the cooling middle performance, the COP during the heating rated performance, and an annual performance factor (APF). A change in the COP during the operation of the cooling middle performance due to the flow-path resistance of the liquid-side distribution pipe 112 is represented by a solid line, a change in the COP during the heating rated performance due to the flow-path resistance of the liquid-side distribution pipe 112 is represented by a dashed line, and a change in the APF due to the flow-path resistance of the liquid-side distribution pipe 112 is represented by a dotted line. In addition, in FIG. 4, a region, in which Expression (9) is satisfied, is illustrated.

As illustrated in FIG. 4, in the construction of the air conditioner 300 according to the first embodiment, the more the flow-path resistance of the liquid-side distribution pipe 112 increases, the more the COP during the operation of the cooling middle performance improves; however, the COP during the heating rated performance tends to decrease. The temperature of the subcooler 120 during the heating operation increases in response to the increase in the flow-path resistance of the liquid-side distribution pipe 112, and the heat release amount increases from the subcooler 120, and the COP decreases.

It is desirable to set the distribution-pipe resistance ΔPLpdt during a heating rated operation as in Expression (10) such that it is possible to increase the APF while reducing the decrease in the COP during the heating rated operation to the largest extent. Here, ΔTsat represents saturation temperature difference [K] due to the distribution-pipe resistance.

$$\Delta T\mathrm{sat}(\Delta PLpdt)\leq 5 \quad (10)$$

In this manner, it is possible to prevent the temperature of the subcooler 120 during the heating rated operation from being higher than the outside temperature, and it is possible to reduce the heat release loss and to improve the COP.

In addition, as the refrigerants used in the refrigeration cycle of the air conditioner 300 according to the first embodiment, it is possible to use a refrigerant obtained by selecting a single from or by mixing a plurality of R32, R410A, R290, R1234yf, R1234ze(E), R134a, R125A, R143a, R1123, R290, R600a, R600, or R744.

In particular, in the refrigeration cycle in which R32 (a mixed refrigerant containing only R32 or 70% by weight of R32) or R744 is used as the refrigerant, it is possible to appropriately use the construction of the air conditioner 300 according to the first embodiment. In a case where R32 (a mixed refrigerant containing only R32 or 70% by weight of R32) or R744 is used, a pressure loss of the heat exchanger tends to be small, and deterioration in the distribution due to the liquid head difference of the refrigerant is likely to occur, compared to a case where another refrigerant is used. Therefore, a use of the air conditioner 300 according to the first embodiment enables to reduce the deterioration in the distribution of the refrigerant and enables the performance of the air conditioner 300 to improve.

In FIG. 3, in the description, the first paths (paths flowing from the gas-side inlets G1 and G2 to the liquid-side outlet L1) of the outdoor heat exchanger 12 (heat exchange unit 110) converge in the three-way bend 4, flow upward while flowing along both ways in the first row F1 in the horizontal direction, and flow downward while flowing both ways in the horizontal direction along both ways from the heat-transfer pipe 2 that is immediately below the heat-transfer pipe 2 of the first row F1 that is connected to the three-way bend 4 using the connection pipe 5; however, the construction of the refrigerant flow path is not limited thereto.

For example, as illustrated in FIG. 5(*a*), the path converges in the three-way bend 4, then, flows downward while flowing along both ways in the first row F1 in the horizontal direction, and flows upward while flowing along both ways in the horizontal direction from the heat-transfer pipe 2 that is immediately above the heat-transfer pipe 2 of the first row F1 that is connected to the three-way bend 4, through the connection pipe 5A.

In addition, as illustrated in FIG. 5(*b*), a construction, in which the path converges in the three-way bend 4, then, flows upward while flowing along both ways in the first row F1 in the horizontal direction, and flows upward while flowing along both ways in the horizontal direction from the heat-transfer pipe 2 of the first row F1 that is at the same stage as the gas-side inlet G2 (here, shifted by the half pitch so as to form the zigzag arrangement) through the connection pipe 5B, may be employed. In addition, although not illustrated, a construction, in which the path converges in the three-way bend 4, then, flows downward while flowing along both ways in the first row F1 in the horizontal direction, and flows downward while flowing along both ways in the horizontal direction from the heat-transfer pipe 2 of the first row F1 that is at the same stage as the gas-side inlet G1 (here, shifted by the half pitch so as to form the zigzag arrangement) through the connection pipe 5, may be employed.

In a case of the construction as illustrated in FIG. 5(*b*), the heat-transfer pipe 2 of the first row F1 that is connected to the three-way bend 4 and the liquid-side outlet L1 come close to each other. Therefore, as illustrated in FIGS. 3 and 5(*a*), the heat-transfer pipe 2 of the first row F1 connected to the three-way bend 4 and the liquid-side outlet L1 are off from each other, and such a construction is more desirable in that the heat conduction loss through the fin 1 is reduced.

Second Embodiment

Next, the air conditioner 300 according to a second embodiment will be described with reference to FIG. 6. FIG. 6 is a layout diagram of refrigerant flow paths in an outdoor heat exchanger 12A of the air conditioner 300 according to the second embodiment. FIG. 6 is a diagram obtained when viewing one end side S1 (refer to FIG. 2(*a*)) of the outdoor heat exchanger 12A.

The air conditioner 300 according to the second embodiment has a different construction of the outdoor heat exchanger 12A, compared to the air conditioner 300 according to the first embodiment. Specifically, the outdoor heat exchanger 12A is different in that the heat-transfer pipes 2 are arranged in three rows (a first row F1, a second row F2, and a third row F3). The other construction is the same, and the repeated description thereof is omitted.

As illustrated in FIG. 6, the gas refrigerants that flow from the gas-side inlets G1 and G2 flow in directions (in the upward direction by the refrigerant from the gas-side inlet G1 and in a downward direction by the refrigerant from the gas-side inlet G2) in which the refrigerant flow paths are off from each other in the vertical direction while flowing along both ways through the heat-transfer pipes 2 of the third row F3 in the horizontal direction, and are off to a predetermined position. Then, the refrigerants flow to the heat-transfer pipe 2 of the second row F2 through the U-bent in which the end portion of the heat-transfer pipe 2 of the third row F3 is connected to the end portion of the heat-transfer pipe 2 of the second row F2. Hereinafter, the flow of the refrigerant in the second row F2 and the first row F1 is the same as the first embodiment (refer to FIG. 3). In other words, the outdoor heat exchanger 12A of the second embodiment has the refrigerant flow path on the gas side, which extends with respect to the two rows of outdoor heat exchangers 12 (refer to FIG. 3).

In this manner, even in a case of a construction in which three rows of the outdoor heat exchangers 12A are provided, it is possible to more improve the high efficiency of the air conditioner 300 in the same manner as the case of the two rows (refer to FIG. 3).

Third Embodiment

Next, the air conditioner 300 according to a third embodiment will be described with reference to FIG. 7. FIG. 7 is a layout diagram of the refrigerant flow paths in an outdoor heat exchanger 12B of the air conditioner 300 according to the third embodiment. FIG. 7 is a diagram obtained when viewing one end side S1 (refer to FIG. 2(*a*)) of the outdoor heat exchanger 12B.

The air conditioner 300 according to the third embodiment has a construction in which the outdoor heat exchanger 12B has three rows (the first row F1, the second row F2, and the third row F3) of heat-transfer pipes 2 are arranged, similar to the air conditioner 300 according to the second embodiment. On the other hand, the outdoor heat exchanger 12B of the third embodiment is different in that the three-way bents 4 are disposed between the third row F3 and the second row F2, compared to the outdoor heat exchanger 12A of the second embodiment in which the three-way bents 4 are disposed between the second row F2 and the first row F1. The other construction is the same, and the repeated description thereof is omitted.

As illustrated in FIG. 7, the flow of the refrigerant in the third row F3 and the second row F2 in the outdoor heat exchanger 12B of the third embodiment is the same as the flow of the refrigerant in the second row F2 and the first row F1 in the outdoor heat exchanger 12 of the first embodiment. The refrigerant flows into the heat-transfer pipe 2 of the first row F1 through a U-bent connected from the end portion of the heat-transfer pipe 2 of the second row F2 in the same stage as the gas-side inlet G2 to the end portion of the heat-transfer pipe 2 of the first row F1 in the same stage as the gas-side inlet G2. The refrigerant that flows into the heat-transfer pipe 2 of the first row F1 from the U-bent flows upward while flowing along both ways in the heat-transfer pipe 2 of the first row F1 in the horizontal direction, and flows out to the liquid-side distribution pipe 112 through the liquid-side outlet L1 on the same stage as the gas-side inlet G1. In other words, the outdoor heat exchanger 12B of the third embodiment has the refrigerant flow path on the liquid side, which extends with respect to the two rows of outdoor heat exchangers 12 (refer to FIG. 3).

In this manner, even in the case of the construction in which three rows of the outdoor heat exchangers 12B are provided, it is possible to more improve the high efficiency of the air conditioner 300 in the same manner as the case of the two rows (refer to FIG. 3). In addition, a length of the flow path of the refrigerant flow path (refrigerant flow path on the liquid side) after the converging in the three-way bent 4 is increased, and thus a region in which the refrigerant flow rate in the heat-transfer pipe 2 is relatively high is increased.

It is desirable to select any one of whether the number of paths and the position of the three-way bends 4 are disposed between the second row F2 and the first row F1 as in the second embodiment so as to have the optimal refrigerant rate depending on the rated performance, a total length of the heat-transfer pipes, a cross-sectional area of the heat-transfer pipe, and types of refrigerants of the air conditioner 300 (refer to FIG. 6), or the three-way bends are disposed between the third row F3 and the second row F2 as in the third embodiment (refer to FIG. 7). In this manner, it is possible to improve the performance of the heat exchanger.

In addition, compared to the refrigerant R410A which is mainly used currently, the pressure loss in the refrigerant flow path is relatively small in a case where R32, R744, or the like is used as the refrigerant. Therefore, the length of the flow path after the converging on the liquid side as in the third embodiment (refer to FIG. 7) is selected to be long, and thereby it is possible to maximize the performance of the outdoor heat exchanger 12B and the air conditioner 300 that includes the outdoor heat exchanger.

Modification Example

The air conditioners 300 according to the embodiments (first to third embodiments) are not limited to the constructions of the embodiments, and it is possible to perform various modifications within a range without departing from the gist of the invention.

As described above, the examples of the air conditioner 300 are described; however, the invention is not limited thereto, and the invention can be widely applied to a refrigeration-cycle apparatus that includes the refrigeration cycle. The invention can be widely applied to a refrigerated-heating show case in which it is possible for items to be refrigerated or heated, a vending machine that refrigerates or heats beverage cans, or a refrigeration-cycle apparatus that includes the refrigeration cycle in a heat pump type water heater in which a liquid is heated and stored, or the like.

In addition, the examples of having two rows or three rows of the outdoor heat exchanger 12 (12A or 12B) in the flowing direction of the outdoor air; however, the construction is not limited thereto, and four rows thereof may be used.

In addition, similar to the outdoor heat exchanger 12 (12A or 12B), the indoor heat exchanger 22 may include a plurality of constructions of paths P (refer to FIG. 3) of refrigerant flow paths. In addition, the construction of the liquid-side distribution pipe 112 of the outdoor heat exchanger 12 may be applied to the liquid-side distribution pipe 212 of the indoor heat exchanger 22.

REFERENCE SIGNS LIST

1: fin
2: heat-transfer pipe
3: U pipe
4: three-way pipe
5: connection pipe
10: compressor
11: four-way valve
12: outdoor heat exchanger
13: outdoor expansion valve
14: receiver
15: liquid-stop valve
16: gas-stop valve
17: accumulator
21: indoor expansion valve
22: indoor heat exchanger
30: liquid piping
40: gas piping
50: outdoor fan
60: indoor fan
100: outdoor device
200: indoor device
300: air conditioner
110: heat exchange unit
111: gas header
112: liquid-side distribution pipe
113: distributor
120: subcooler
130: subcooler
S1: one end portion
S2: the other end portion
F1: first row (row of heat-transfer pipes)
F2: second row (row of heat-transfer pipes)
F3: third row (row of heat-transfer pipes)
G1, G2: gas-side inlet
L1: liquid-side outlet

The invention claimed is:

1. An air-conditioning device comprising:

a heat exchanger that includes heat-transfer pipes, through which a refrigerant flows, and that performs heat exchange with air, wherein the heat exchanger has one end portion and an other end portion that is opposite the one end portion, wherein the heat-transfer pipes are arranged such that refrigerant flows both ways between the one end portion and the other end portion and the heat-transfer pipes are arranged side-by-side in a direction intersecting with a direction of flow of the air, and form rows of the heat-transfer pipes, wherein the rows of the heat-transfer pipes arranged side-by-side in the intersecting direction has:

a first row that is positioned on an upstream side in the direction of flow of the air, and a second row that is positioned to be neighboring to the first row in the direction of flow of the air, wherein the heat exchanger includes a refrigerant flow path into which a gas refrigerant flows from two gas-side inlets in the second row, when the heat exchanger functions as a condenser, wherein the refrigerant flow path in the second row includes a first refrigerant flow path and a second refrigerant flow path which are formed such that refrigerant flowing in the first refrigerant flow path flows toward refrigerant flowing in the second refrigerant flow path, in a vertical direction, while the first refrigerant flow path and the second refrigerant flow path are arranged along both ways between the one end portion and the other end portion, wherein with respect to refrigerant flowing in the vertical direction in the second row, refrigerant flowing from the one of the two gas-side inlets flows only toward the refrigerant flowing in the second refrigerant flow path and refrigerant flowing from the other of the two gas-side inlets flows only toward refrigerant flowing in the first refrigerant flow path, wherein the first refrigerant flow path and the second refrigerant flow path from the two gas-side inlets converge in the one end portion, wherein the refrigerant flow path connects to a heat-transfer pipe in the first row from the second row, wherein the refrigerant flow path includes a refrigerant path which is formed in a range from a same stage as one of the two gas-side inlets of the second row to a same stage as the other of the two gas-side inlets of the second row, while being arranged along both ways between the one end portion and the other end portion in the first row, and the refrigerant flow path extends to a liquid-side outlet, and wherein the refrigerant flow path in the first row includes:

a third refrigerant flow path extending from the heat-transfer pipe of the first row that is connected to the second row to a heat-transfer pipe of the first row in the same stage as said one of the two gas-side inlets of the second row, a fourth refrigerant flow path extending from a heat-transfer pipe adjacent to the heat-transfer pipe of the first row that is connected to the second row to a heat-transfer pipe of the first row in the same stage as the other of the two gas-side inlets of the second row, and a connection pipe that connects the third refrigerant flow path and the fourth refrigerant flow path.

2. The air-conditioning device according to claim 1, wherein the heat exchanger is provided with the refrigerant flow paths extending from the two gas-side inlets to the liquid-side outlet.

3. The air-conditioning device according to claim 2, wherein the liquid-side outlet includes a plurality of liquid-side outlets which connect with liquid-side distribution pipes, respectively, and wherein pressure losses of the liquid-side distribution pipes are set to pressure losses within ±20% of each other.

4. The air-conditioning device according to claim 2, wherein the liquid-side outlet includes a plurality of liquid-side outlets which connect with liquid-side distribution pipes, respectively, and wherein, in a case of a pressure loss $\Delta PLp$ [Pa] of a liquid-side distribution pipe, the height dimension H [m] of the heat exchanger, liquid refrigerant density $\rho L$ [$kg/m^3$], and gravitational acceleration g [$kg/s^2$], during an operation with cooling middle performance in which 50% of rated cooling performance is generated, a relationship of $\Delta PLp \geq 0.5\ \rho L \cdot g \cdot H$ is satisfied.

5. The air-conditioning device according to claim 2, wherein the liquid-side outlet includes a plurality of liquid-side outlets which are connected with liquid-side distribution pipes, respectively, and wherein a pressure loss $\Delta PLpdt$ [Pa] of the liquid-side distribution pipe during a heating rated performance operation causes saturation temperature difference $\Delta Tsat$ ($\Delta PLpdt$) to be 5 K or lower.

6. The air-conditioning device according to claim 1, wherein the heat exchanger is disposed in an outdoor device of the air conditioner, wherein two zones of subcoolers are formed below the heat exchanger, wherein an expansion valve is provided at an intermediate position between one subcooler and the other subcooler, and wherein the expansion valve serves a pressure reduction operation during the heating operation of the air conditioner.

7. The air-conditioning device according to claim 6, wherein a refrigerant temperature of the refrigerant which flows into the subcooler disposed on the downstream side of the expansion valve during the heating operation, of the subcoolers is reduced to be lower than an air temperature during the heating operation.

8. The air-conditioning device according to claim 1, wherein the height dimension H [m] of the heat exchanger is 0.5 m or higher.

9. The air-conditioning device according to claim 1, wherein any one of R32, a mixed refrigerant containing 70% by weight or greater of R32, or R744 is used as the refrigerant.

* * * * *